US009748028B2

(12) United States Patent
Shingaki et al.

(10) Patent No.: US 9,748,028 B2
(45) Date of Patent: *Aug. 29, 2017

(54) METHOD FOR PRODUCING GRAIN-ORIENTED ELECTRICAL STEEL SHEET

(71) Applicant: JFE STEEL CORPORATION, Tokyo (JP)

(72) Inventors: Yukihiro Shingaki, Kurashiki (JP); Takeshi Imamura, Kurashiki (JP); Ryuichi Suehiro, Kurashiki (JP); Yasuyuki Hayakawa, Asakuchi (JP); Yuiko Wakisaka, Kurashiki (JP)

(73) Assignee: JFE STEEL CORPORATION, Tokyo (JP)

( * ) Notice: Subject to any disclaimer, the term of this patent is extended or adjusted under 35 U.S.C. 154(b) by 269 days.

This patent is subject to a terminal disclaimer.

(21) Appl. No.: 14/414,623

(22) PCT Filed: Jul. 25, 2013

(86) PCT No.: PCT/JP2013/070186

§ 371 (c)(1),
(2) Date: Jan. 13, 2015

(87) PCT Pub. No.: WO2014/017590

PCT Pub. Date: Jan. 30, 2014

(65) Prior Publication Data

US 2015/0194247 A1 Jul. 9, 2015

(30) Foreign Application Priority Data

Jul. 26, 2012 (JP) ..... 2012-165519

(51) Int. Cl.

| | |
|---|---|
| ***C22C 38/04*** | (2006.01) |
| ***H01F 1/147*** | (2006.01) |
| ***C21D 8/12*** | (2006.01) |
| ***C22C 38/00*** | (2006.01) |
| ***H01F 1/16*** | (2006.01) |
| ***C22C 38/02*** | (2006.01) |
| ***C22C 38/08*** | (2006.01) |
| ***C22C 38/12*** | (2006.01) |
| ***C22C 38/14*** | (2006.01) |
| ***C22C 38/18*** | (2006.01) |
| ***C21D 6/00*** | (2006.01) |
| ***C21D 9/46*** | (2006.01) |
| ***C22C 38/34*** | (2006.01) |

(52) U.S. Cl.

CPC ..... *H01F 1/14775* (2013.01); *C21D 6/001* (2013.01); *C21D 6/002* (2013.01); *C21D 6/005* (2013.01); *C21D 6/008* (2013.01); *C21D 8/12* (2013.01); *C21D 8/1222* (2013.01); *C21D 8/1233* (2013.01); *C21D 8/1261* (2013.01); *C21D 8/1266* (2013.01); *C21D 8/1272* (2013.01); *C21D 8/1283* (2013.01); *C21D 9/46* (2013.01); *C22C 38/00* (2013.01); *C22C 38/002* (2013.01); *C22C 38/008* (2013.01); *C22C 38/02* (2013.01); *C22C 38/04* (2013.01); *C22C 38/08* (2013.01); *C22C 38/12* (2013.01); *C22C 38/14* (2013.01); *C22C 38/18* (2013.01); *C22C 38/34* (2013.01); *H01F 1/16* (2013.01); *C21D 2201/05* (2013.01)

(58) Field of Classification Search

CPC ..... C22C 38/00; C22C 38/02; C22C 38/04
See application file for complete search history.

(56) References Cited

U.S. PATENT DOCUMENTS

| | | | |
|---|---|---|---|
| 4,898,626 | A | 2/1990 | Shoen et al. |
| 4,975,127 | A | 12/1990 | Kurosawa et al. |
| 2009/0165895 | A1 | 7/2009 | Ushigami et al. |

(Continued)

FOREIGN PATENT DOCUMENTS

| | | | |
|---|---|---|---|
| CN | 101454465 | A | 6/2009 |
| EP | 2 213 754 | A1 | 8/2010 |
| JP | A-63-105926 | | 5/1988 |
| JP | A-7-62436 | | 3/1995 |
| JP | A-7-62437 | | 3/1995 |
| JP | H07-062436 | A | 3/1995 |
| JP | A-7-312308 | | 11/1995 |
| JP | H10-130729 | A | 5/1998 |
| JP | A-10-298653 | | 11/1998 |

(Continued)

OTHER PUBLICATIONS

Human English Translation of JP S 63-105926A of Iwamoto et al. dated May 11, 1988.*

(Continued)

*Primary Examiner* — Roy King
*Assistant Examiner* — Jophy S Koshy
(74) *Attorney, Agent, or Firm* — Oliff PLC

(57) ABSTRACT

In a method for producing a grain-oriented electrical steel sheet by hot rolling a steel slab having a chemical composition including C: 0.001~0.10 mass %, Si: 1.0~5.0 mass %, Mn: 0.01~0.5 mass %, Al: less than 0.0100 mass %, each of S, Se, O and N: not more than 0.0050 mass % and the remainder being Fe and inevitable impurities, subjecting the resulting hot rolled sheet to a single cold rolling or two or more cold rollings sandwiching an intermediate annealing therebetween to a final thickness, subjecting to a primary recrystallization annealing, applying an annealing separator thereto and then subjecting to a finish annealing, a zone of 550~700° C. in a heating process of the primary recrystallization annealing is rapidly heated at an average heating rate of 40~200° C./s, while any temperature zone of 250~550° C. is kept at a heating rate of not more than 10° C./s for 1~10 seconds, whereby secondary recrystallized grains are refined to obtain a grain-oriented electrical steel sheet stably realizing a low iron loss.

6 Claims, 3 Drawing Sheets

(56) References Cited

U.S. PATENT DOCUMENTS

| | | | |
|---|---|---|---|
| 2015/0170813 | A1 | 6/2015 | Shingaki et al. |
| 2015/0187473 | A1 | 7/2015 | Imamura et al. |
| 2016/0319390 | A1 | 11/2016 | Imamura et al. |

FOREIGN PATENT DOCUMENTS

| | | | |
|---|---|---|---|
| JP | A-2000-204450 | | 7/2000 |
| JP | A-2003-27194 | | 1/2003 |
| JP | 2008-001979 | A | 1/2008 |
| JP | A-2008-1983 | | 1/2008 |
| JP | 2008-266727 | A | 11/2008 |
| JP | 2013-047383 | A | 3/2013 |
| JP | A-2013-139629 | | 7/2013 |

OTHER PUBLICATIONS

Oct. 15, 2013 International Search Report issued in International Application No. PCT/JP2013/070186.
Jan. 29, 2016 Search Report issued in European Patent Application 13822589.1.
Search Report issued in PCT/JP2013/070187 mailed Oct. 15, 2013.
Jan. 27, 2015 International Preliminary Report on Patentability issued in Application No. PCT/JP2013/070187.
Shiraiwa et al, Recrystallization Process of AI-Killed Steel during Isothermal Annealing, 1971, pp. 20-28.
Sep. 21, 2015 Office Action issued in Chinese Application No. 201380037789.1.
Jan. 29, 2016 Search Report issued in European Application No. 13823812.6.
Feb. 23, 2016 Office Action issued in Korean Application No. 2015-7000715.
Aug. 31, 2015 Office Action issued in corresponding Chinese Patent Application No. 201380038008.0 (Translation Only).
Dec. 18, 2015 US office action issued in U.S. Appl. No. 14/415,089.
Feb. 17, 2016 Extended European Search Report in European Patent Application No. 13822382.1.
Mar. 30, 2016 Office Action issued in Chinese Patent Application No. 201380038008.0.
Sep. 9, 2016 Office Action Issued in U.S. Appl. No. 14/415,089.
Dec. 18, 2015 Office Action issued in U.S. Appl. No. 14/415,089.
Apr. 7, 2016 Office Action issued in U.S. Appl. No. 14/415,089.
Oct. 15, 2013 International Search Report issued in International Application No. PCT/JP2013/070185.
Oct. 1, 2015 Office Action issued in U.S. Appl. No. 14/415,027.
Apr. 7, 2016 Office Action issued in U.S. Appl. No. 14/415,027.
Sep. 29, 2016 Office Action issued in U.S. Appl. No. 14/415,027.
Jan. 12, 2017 Office Action Issued in U.S. Appl. No. 15/208,720.
Jan. 17, 2017 Notice of Allowance issued in U.S. Appl. No. 14/415,089.
Apr. 27, 2017 Office Action issued in U.S. Appl. No. 14/415,027.

* cited by examiner

METHOD FOR PRODUCING GRAIN-ORIENTED ELECTRICAL STEEL SHEET

TECHNICAL FIELD

This invention relates to a method for producing a grain-oriented electrical steel sheet having an excellent iron loss property.

RELATED ART

The grain-oriented electrical steel sheet is a soft magnetic material, a crystal orientation of which is highly accumulated into Goss orientation ({110}<001>), and is widely used as an iron core for a transformer, a motor or the like. Among them, the grain-oriented electrical steel sheet used in the transformer is strongly demanded to be low in the iron loss in order to decrease no-load loss (energy loss). As a method for decreasing the iron loss in the grain-oriented electrical steel sheet, it is known that the decrease of sheet thickness, the increase of Si addition, the improvement of crystal orientation, the application of tension to steel sheet, the smoothening of steel sheet surface, the refining of secondary recrystallization structure or the like is effective.

As a technique of refining secondary recrystallized grains among the above methods, there are proposed a method of performing rapid heating during decarburization annealing, a method of performing rapid heating just before decarburization annealing to improve a primary recrystallized texture and so on as disclosed in Patent Documents 1-4. For example, Patent Document 1 discloses a technique of producing a grain-oriented electrical steel sheet with a low iron loss by heating a cold rolled steel sheet rolled to a final thickness in a non-oxidizing atmosphere having $P_{H2O}/P_{H2}$ of not more than 0.2 at a heating rate of not less than 100° C./s up to a temperature of not lower than 700° C. just before decarburization annealing. Also, Patent Document 3 and the like disclose a technique of producing a grain-oriented electrical steel sheet having excellent coating properties and magnetic properties by heating a zone of not lower than 600° C. at a heating rate of not less than 95° C./s to not lower than 800° C. and properly controlling an atmosphere in this temperature zone.

The technique of improving the primary recrystallized texture by the rapid heating unambiguously defines a heating rate with respect to a temperature range from approximately room temperature to not lower than 700° C. as a temperature range for rapid heating. This technical idea is understood as an attempt for improving the primary recrystallized texture by raising a temperature near to a recrystallization temperature in a short time to suppress development of γ-fibers ({111} fiber structure), which is preferentially formed at a usual heating rate, and to promote generation of {110}<001> structure as nuclei for secondary recrystallization or the like. By the application of this technique can be refined the secondary recrystallized grains to improve the iron loss.

As the technique of performing the rapid heating, there is a technique disclosed in Patent Document 5 wherein the effect by the rapid heating of not less than 50° C./s can be developed by properly controlling the rolling conditions, but it is said that the big effect is obtained at a heating rate of about 80° C./s or a further higher rate. However, in order to increase the heating rate, a special, large-scale heating installation for induction heating, electric heating or the like is necessary and there is a problem that input of considerable energy is required in a short time. Also, there is a problem that the form of the steel sheet is deteriorated due to rapid temperature change by the rapid heating to deteriorate the sheet threading performance in the production line.

PRIOR ART DOCUMENTS

Patent Documents

Patent Document 1: JP-A-H07-062436
Patent Document 2: JP-A-H10-298653
Patent Document 3: JP-A-2003-027194
Patent Document 4: JP-A-2000-204450
Patent Document 5: JP-A-H07-062437

SUMMARY OF THE INVENTION

Task to be Solved by the Invention

The invention is made in view of the above problems of the conventional techniques and is to propose a production method wherein when a heating rate in the primary recrystallization annealing is as high as not less than 80° C./s as in the conventional technique, the effect equal to that at a higher heating rate is obtained and even if it is as relatively low as less than 80° C./s, the effect by the rapid heating is developed to attain the refining of secondary recrystallized grains more efficiently as compared to the conventional technique, whereby grain-oriented electrical steel sheets with a low iron loss can be obtained stably.

Solution for Task

The inventors have made various studies on ideal conditions of heat cycle in primary recrystallization annealing, especially heating rate (heating pattern) in order to solve the above problems from various viewpoints. As previously mentioned, it is considered that the purpose of rapidly heating up to a temperature of about 700° C. in the heating process of the primary recrystallization annealing lies in relative promotion of recrystallization of: Goss structure {110}<001> by passing a temperature zone of preferentially promoting recrystallization of: γ-fiber {111} fiber texture or a temperature range of 550° C. and 580° C. in a short time.

On the contrary, a temperature zone lower than a zone of 550-700° C. preferentially growing {222}, which is conventionally equivalent to {111}, in the heating process causes recovery of structure or polygonization of dislocation to decrease dislocation density, but is not sufficient for the recrystallization. Therefore, even if the former temperature zone is kept for a long time, recrystallization of {222} is not promoted almost. However, it has been found that since the dislocation density is largely lowered in such a temperature zone as strain accumulation of the structure becomes higher, the primary recrystallization texture can be largely changed by keeping at the zone for a short time to effectively develop the refining effect of secondary recrystallized grains, and as a result, the invention has been accomplished.

That is, the invention is a method for producing a grain-oriented electrical steel sheet by hot rolling a steel slab having a chemical composition comprising C: 0.001-0.10 mass %, Si: 1.0-5.0 mass %, Mn: 0.01-0.5 mass %, Al: less than 0.0100 mass %, each of S, Se, O and N: not more than 0.0050 mass % and the remainder being Fe and inevitable impurities, subjecting the resulting hot rolled sheet to a single cold rolling or two or more cold rollings sandwiching an intermediate annealing therebetween to a final thickness after or without hot band annealing, subjecting the resulting cold rolled sheet to a primary recrystallization annealing, applying an annealing separator thereto and then subjecting to a finish annealing, characterized in that a zone of 550-700° C. in a heating process of the primary recrystallization annealing is rapidly heated at an average heating rate of 40-200° C./s, while any temperature zone of 250-550° C. is kept at a heating rate of not more than 10° C. for 1-10 seconds.

The steel slab in the production method of the grain-oriented electrical steel sheet according to the invention contains one or more selected from Cu: 0.01-0.2 mass %, 0.01-0.5 mass %, Cr: 0.01-0.5 mass %, Sb: 0.01-0.1 mass %, Sn: 0.01-0.5 mass %, Mo: 0.01-0.5 mass %, Bi: 0.001-0.1 mass %, Ti: 0.005-0.02 mass %, P: 0.001-0.05 mass % and Nb: 0.0005-0.0100 mass % in addition to the above chemical composition.

In the production method of the grain-oriented electrical steel sheet according to the invention, a sulfide and/or a sulfate is added to the annealing separator, or a nitriding treatment is performed after the primary recrystallization.

Effect of the Invention

According to the invention, even when the heating rate in the heating process of the primary recrystallization annealing is relatively low, there can be developed the refining effect of secondary recrystallized grains equal to or more than that of the conventional technique performing the rapid heating at a higher heating rate, so that it is possible to easily and stably obtain grain-oriented electrical steel sheets with a low iron loss property.

EMBODIMENTS FOR CARRYING OUT THE INVENTION

Figure 1:
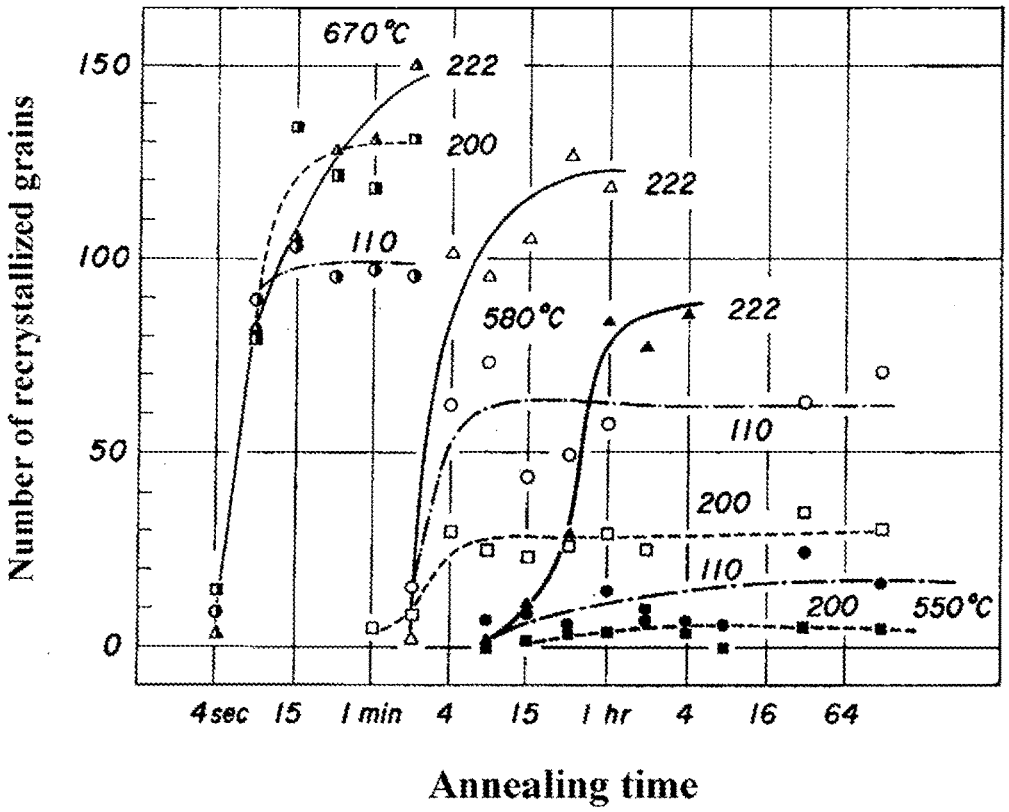
FIG. 1 (Related Art)
FIG. 1 is a graph showing an influence of an annealing temperature upon annealing time and number of recrystallized grains in Al killed steel.

Experiments building a momentum for developing the invention will be described below.

<Experiment 1>

A steel slab having a chemical composition comprising C: 0.03 mass %, Si: 3.1 mass %, Mn: 0.03 mass %, Al: less than 0.0100 mass %, each of S, Se, O and N: not more than 0.0050 mass % and the remainder being Fe and inevitable impurities is hot rolled to obtain a hot rolled sheet, which is subjected to a hot band annealing and to a single cold rolling to obtain a cold rolled sheet (coil) of 0.30 mm in thickness. Thereafter, 30 test specimens of L: 300 mm×C: 100 mm are cut out from a central portion of the cold rolled coil in longitudinal and widthwise directions thereof Then, the test specimens are heated to a temperature of 700° C. at various heating rates with an electrical heating apparatus and thereafter subjected to primary recrystallization annealing combined with decarburization annealing of heating to 800° C. at 30° C./s and keeping in a wet hydrogen atmosphere for 60 seconds. Moreover, the heating in the primary recrystallization annealing is conducted by three heating patterns, i.e. a heating pattern 1 wherein the temperature is continuously raised from room temperature to 700° C. at a constant heating rate and a zone from 700° C. to 800° C. is heated at a constant heating rate, a heating pattern 2 wherein a temperature of 450° C. on the way of the heating to 700° C. is kept for 3 seconds, and a heating pattern 3 wherein a temperature of 450° C. on the way of the heating to 700° C. is kept for 15 seconds. Moreover, the heating rate in the heating patterns 2 and 3 means a heating rate before and after the keeping, and the conditions of atmosphere and the like in the heating patterns 2 and 3 are the same as in the heating pattern 1.

Then, the test specimen after the primary recrystallization (decarburization) annealing is coated on its surface with an annealing separator composed mainly of MgO and subjected to a secondary recrystallization annealing (finish annealing) at 1150° C. for 10 hours, and thereafter a phosphate based insulating tensile coating is applied and baked thereon.

Figure 2:
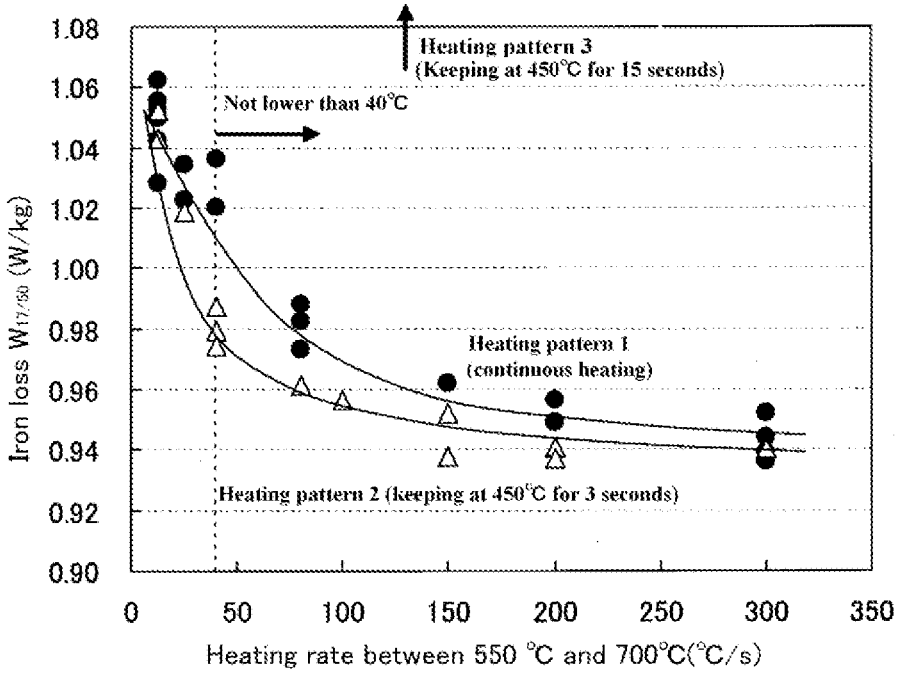
FIG. 2 is a graph showing an influence of heating pattern upon a relation between a heating rate in a zone of 550-700° C. and an iron loss.

With respect to the test specimens thus obtained after the finish annealing is measured an iron loss $W_{17/50}$ (iron loss when being excited to a magnetic flux density of 1.7 T at a commercial frequency of 50 Hz) with SST (single sheet testing apparatus) and the measured results are shown in FIG. 2. As seen from this figure, in case of the heating pattern 2 keeping at 450° C. for 3 seconds on the way of the heating, satisfactory iron loss is obtained as compared with the heating pattern 1 continuously raising the temperature. For example, even in the heating rate of 40° C./s in the heating pattern 2 is obtained the iron loss equal to that at the heating rate of 80° C./s in the heating pattern 1. On the contrary, in case of the heating pattern 3 keeping at 450° C. for 15 seconds on the way of the heating, the iron loss $W_{17/50}$ is 1.10 W/kg in all of the test specimens (not shown), and further the secondary recrystallization is not developed when the heating rate is not less than 100° C./s.

<Experiment 2>

Figure 3:
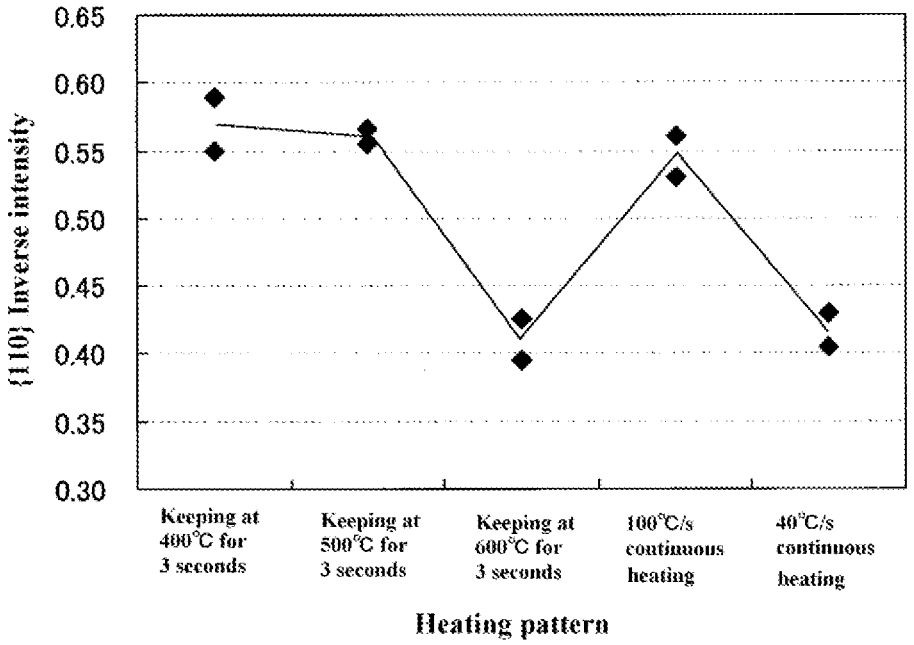
FIG. 3 is a graph showing an influence of heating pattern upon {110} inverse intensity.

Test specimens of the same size are cut out from the cold rolled coil obtained in Experiment 1 at the same position, heated with an electric heating apparatus under a condition of continuously heating from room temperature to 700° C. at a heating rate of 40° C./s or 100° C./s or under a condition that either one of temperatures of 400° C., 500° C. and 600° C. is kept for 3 seconds on the way of the heating from room temperature to 700° C. at a heating rate of 100° C./s and then subjected to a primary recrystallization annealing combined with decarburization annealing wherein it is heated from 700° C. to 800° C. at a heating rate of 30° C./s and kept in a wet hydrogen atmosphere for 60 seconds. With respect to the primary recrystallization annealed sheets thus obtained is measured an inverse intensity by an X-ray diffractometry, from which it is confirmed that when being kept at 400° C. and 500° C., {110} inverse intensity is higher as compared with the case keeping at 600° C. or the case of continuously heating at 40° C./s and is equal to or more than that in the rapid heating at 100° C./s, or that recrystallization of Goss orientation ({110}<001>) grains as nuclei in the secondary recrystallization is promoted as shown in FIG. 3.

The mechanism causing such a phenomenon is considered as follows.

In general, it is considered that a driving force causing the recrystallization is strain energy, and release of strain energy is easily caused in a portion having high strain energy. Therefore, the phenomenon of preferentially causing the recrystallization as disclosed in the technical document (Siraiwa, Terasaki and Kodama, "Recrystallization behavior during isothermal annealing in Al killed steel", Journal of The Japan Institute of Metals and Materials, vol. 35, No. 1, p 20) indicates that the high strain energy is stored in {222} structure (see FIG. 1).

When the cold rolled steel sheet is kept for a short time at a temperature zone of the structure recovery due to dislocation polygonization and strain energy reduction, the decrease of strain energy becomes larger in {222} having a high strain energy as compared with the other crystal orientations. As a result, when it is kept at a temperature causing the recovery, a difference of strain energy stored during rolling depending on the structure is lost and preferential growth of {222} structure in the recrystallization is deteriorated. The effect of the keeping on the way of the heating is the same as the effect by rapidly heating at a high heating rate from a viewpoint of the texture formed after the primary recrystallization annealing.

On the other hand, if the sheet is kept at a temperature zone recovering the structure beyond necessity, the strain energy is reduced and the driving force for causing the recrystallization of {222} structure is largely decreased. Since {222} structure is necessary to be existent with a constant quantity as a structure encroached by Goss grains, when the recrystallization of {222} structure is suppressed excessively, there is a high possibility that primary recrystallized structure enough to cause the secondary recrystallization is not obtained. Therefore, it is considered that when the heating rate is relatively slow, the effect equal to that in the high heating rate is obtained only by keeping at a temperature zone of recovering the structure in a very short time and that even in case of the high heating rate, the effect equal to that under a condition of a further higher heating rate is obtained.

Next, there will be described the chemical composition of the grain-oriented electrical steel sheet aimed at the invention.

C: 0.001-0.10 Mass %

C is an element useful for generating crystal grains of Goss orientation, and is necessary to be not less than 0.001 mass % for developing such an action effectively. While when it exceeds 0.10 mass %, there is a risk of causing poor decarburization in the decarburization annealing. Therefore, the C content is a range of 0.001-0.10 mass %, preferably a range of 0.01-0.08 mass %.

Si: 1.0-5.0 Mass %

Si has an effect of increasing electrical resistance of steel to decrease the iron loss and is necessary to be contained in an amount of at least 1.0 mass %. While, when it exceeds 5.0 mass %, it is difficult to perform cold rolling. Therefore, the Si content is a range of 1.0-5.0 mass %, preferably a range of 2.0-4.5 mass %.

Mn: 0.01-0.5 Mass %

Mn is an element effective for improving hot workability of steel and is necessary to be contained in an amount of not less than 0.01 mass %. While, when it exceeds 0.5 mass %, austenite fraction is increased in the hot rolling and the texture is undesirably deteriorated. Therefore, the Mn content is a range of 0.01-0.5 mass %, preferably a range of 0.01-0.10 mass %.

Al: Less than 0.0100 Mass %, Each of N, S and Se: Not More than 0.0050 Mass %

Al, N, S and Se are ingredients forming an inhibitor. When they are added excessively, a temperature causing secondary recrystallization rises and it is difficult to control the secondary recrystallization. Also, when the inhibitor forming elements are existent largely, a high slab heating temperature is required due to their dissolution and dispersion, and if the slab heating temperature is insufficient, coarsened AlN, MnS, MnSe and the like make the primary recrystallization structure non-uniform, which causes defect of secondary recrystallization. Therefore, it is necessary that the Al content is less than 0.0100 mass % and each of N, S and Se contents is not more than 0.0050 mass %. Preferably, Al is not more than 0.0050 mass %, and each of N, S and Se is not more than 0.0030 mass %.

In the grain-oriented electrical steel sheet aimed by the invention, the remainder other than the above ingredients is Fe and inevitable impurities. Moreover, O has an inhibitor effect of forming an oxide to obstruct the secondary recrystallization, so that it is desirable to be decreased to not more than 0.0050 mass % in a steel making stage of producing steel slab.

Moreover, the grain-oriented electrical steel sheet aimed by the invention can contain one or more selected from Cu: 0.01-0.2 mass %, Ni: 0.01-0.5 mass %, Cr: 0.01-0.5 mass %, Sb: 0.01-0.1 mass %, Sn: 0.01-0.5 mass %, Mo: 0.01-0.5 mass %, Bi: 0.001-0.1 mass %, Ti: 0.005-0.02 mass %, P: 0.001-0.05 mass % and Nb: 0.0005-0.0100 mass % in addition to the above necessary ingredients.

They are elements having an auxiliary action as an inhibitor by segregation in crystal grain boundary or surface or formation of carbonitride. In the chemical composition of the invention not adding the inhibitor positively, the addition of these elements can suppress variation of primary recrystallized grain size due to the scattering of temperature in the production step. However, when the addition amount is less than the lower limit of the above range, the above effect is not obtained sufficiently, while when it exceeds the upper limit of the above range, poor appearance of the coating or poor secondary recrystallization is easily caused.

In the chemical composition of the invention not adding the inhibitor positively, the crystal grains are gradually coarsened even in the initial stage of the secondary recrystallization annealing. As previously mentioned, if the temperature at the upstream step is shifted to a high temperature side, the grain size in the primary recrystallization may become large. In order to perform the secondary recrystallization, it is necessary that the primary recrystallized grain size before the secondary recrystallization is suppressed to a certain level, concretely not more than 35 μm, so that the driving force required for the secondary recrystallization may be lost in some cases to cause the defect of secondary recrystallization. In order to suppress this defect, the conventionally known technique of performing the nitriding treatment before the secondary recrystallization is applied or a sulfide or sulfate is added to the annealing separator to conduct sulfurizing in the steel sheet, whereby it is possible to properly control the grain growth in the secondary recrystallization annealing to suppress the defect of secondary recrystallization.

Next, there will be described the production method of the grain-oriented electrical steel sheet according to the invention.

The method for producing the grain-oriented electrical steel sheet according to the invention is a production method comprising a series of steps of hot rolling a steel slab having the aforementioned chemical composition, subjecting a hot rolled sheet to a single cold rolling or two or more cold rollings sandwiching an intermediate annealing to a final thickness with or without hot band annealing, subjecting to primary recrystallization annealing, applying an annealing separator and then subjecting to secondary recrystallization annealing.

The production method of the above steel slab is not particularly limited, and the slab can be produced by melting the steel of the aforementioned chemical composition through the conventionally well-known refining process, and then subjecting to continuous casting, ingot making-blooming or the like.

Thereafter, the steel slab is subjected to hot rolling. The reheating temperature of the steel slab prior to the hot rolling is not particularly limited as long as it is a temperature capable of performing the hot rolling in the chemical composition of the invention not adding the inhibitor positively, but is preferable to be not lower than 1100° C.

The hot rolled sheet after the hot rolling is subjected to a single cold rolling or two or more cold rollings sandwiching an intermediate annealing therebetween after or without hot band annealing to obtain a cold rolled sheet with a final thickness. Moreover, the production conditions from the hot rolling to the cold rolling are not particularly limited and may be used according to usual manner.

Then, the cold rolled sheet with the final thickness is subjected to primary recrystallization annealing. In the primary recrystallization annealing, it is necessary that rapid heating is performed between 550° C. and 700° C. at an average heating rate of 40-200° C./s, while a heating rate of not more than 10° C./s at any temperature zone between 250° C. and 550° C. as a previous step is kept for 1-10 seconds.

The reason why the temperature zone performing the rapid heating is a range of 550-700° C. is due to the fact that such a temperature zone is a temperature range of preferential recrystallization of {222} as disclosed in the aforementioned technical document and the generation of {110}<001> orientation as nuclei for secondary recrystallization can be promoted by rapidly heating this temperature range and hence the secondary recrystallization texture is refined to improve the iron loss.

Also, the reason why the average heating rate in the above temperature range is 40-200° C./s is due to the fact that when it is less than 40° C./s, the effect of improving the iron loss is not sufficient, while when it exceeds 200° C./s, the effect of improving the iron loss is saturated.

Further, the reason why the heating rate of not more than 10° C./s at any temperature zone between 250° C. and 550° C. is kept for 1-10 seconds is due to the fact that the effect of improving the iron loss can be obtained even if the heating is performed between 550° C. and 700° C. at a lower heating rate as compared to the conventional technique of continuously raising the temperature. Moreover, the heating rate of not more than 10° C./s may be a negative heating rate as long as the temperature of the steel sheet is not outside of the range of 250-550° C.

That is, the invention is a technical idea that the temperature zone causing the lowering of dislocation density and not causing the recrystallization is kept for a short time to lower the superiority of {222} recrystallization. Therefore, the above effect is not obtained at a temperature of lower than 250° C. not anticipating the movement of dislocation, while the recrystallization of {222} starts when the temperature exceeds 550° C. and hence the generation of {110}<001> orientation cannot be promoted even if the temperature of higher than 550° C. is kept. Also, when the keeping time is less than 1 second, the effect by keeping is not sufficient, while when it exceeds 10 seconds, the recovery is excessively promoted and hence there is a risk of causing the poor secondary recrystallization.

The steel sheet after the primary recrystallization annealing satisfying the above conditions is subjected to a finish annealing for secondary recrystallization after the surface of the steel sheet is coated with an annealing separator and dried. As the annealing separator can be used, for example, ones composed mainly of MgO and properly added with $TiO_2$ or the like, if necessary, ones composed mainly of $SiO_2$ or $Al_2O_3$, and so on. Moreover, the conditions of the finish annealing are not particularly limited, and may be used according to usual manner.

The steel sheet after the finish annealing is preferable to be made to a product by applying and baking an insulating coating onto the steel sheet surface or applying an insulating coating to the steel sheet surface and subjecting to a flattening annealing combined with the baking and the shape correction. Moreover, the kind of the insulating coating is not particularly limited. If the insulating coating providing tensile tension is formed on the steel sheet surface, it is preferable to apply a coating solution containing phosphate-chromic acid-colloidal silica as disclosed in JP-A-S50-79442, JP-A-S48-39388 or the like and bake at about 800° C. Also, in case of using the annealing separator composed mainly of $SiO_2$ or $Al_2O_3$, since forsterite coating is not formed on the steel sheet surface after the finish annealing, the insulating coating may be newly formed after applying an aqueous slurry composed mainly of MgO and performing an annealing for forming forsterite coating.

According to the aforementioned production method of the invention, the secondary recrystallization structure can be refined stably over substantially a full length of a product coil to provide good iron loss property.

Example 1

A steel slab containing C: 0.06 mass %, Si: 3.3 mass %, Mn: 0.08 mass %, S: 0.001 mass %, Al: 0.002 mass %, N: 0.002 mass %, Cu: 0.05 mass % and Sb: 0.01 mass % is heated at 1100° C. for 30 minutes and hot rolled to obtain a hot rolled sheet having a thickness of 2.2 mm, which is subjected to a hot band annealing at 1000° C. for 1 minute and cold rolled to obtain a cold rolled coil having a final thickness of 0.23 mm.

A sample of L: 300 mm×C: 100 mm is taken out from a central portion of the cold rolled coil thus obtained in longitudinal and widthwise directions and subjected to primary recrystallization annealing combined with decarburization annealing with an induction heating apparatus in a laboratory. In the primary recrystallization annealing, the heating is performed by two kinds of patterns as shown in Table 1, i.e. a pattern of continuously heating from room temperature (RT) to 700° C. at a constant heating rate of 20-300° C./s (No. 1, 2, 9, 11, 13) and a pattern of heating a zone of T1-T2 on the way of the above heating between the above temperatures at a given heating rate for a given time (No. 3-8, 10, 12) and then the heating is performed from 700° C. to 820° C. at a heating rate of 40° C./s, and decarburization is performed in a wet hydrogen atmosphere at 820° C. for 2 minutes.

Then, the sample after the primary recrystallization annealing is coated with an aqueous slurry of an annealing separator composed mainly of MgO and containing 5 mass % of TiO2, dried, subjected to a final finish annealing and a phosphate-based insulating tension coating is applied and baked to obtain a grain-oriented electrical steel sheet.

With respect to each of the samples thus obtained, iron loss $W_{17/50}$ is measured by a single sheet magnetic testing method (SST), and thereafter the insulating coating and forsterite coating are removed from the steel sheet surface by pickling to measure a grain size of secondary recrystallized gains. Moreover, the measurement of iron loss is conducted over 20 sheets per one heating condition and the iron loss is evaluated by an average value. The grain size of the secondary recrystallized grains is measured by using a line segment method on a test specimen of 300 mm in length.

The measured results are also shown in Table 1. As seen from these results, the steel sheets subjected to the primary recrystallization annealing under conditions adapted to the invention are small in the grain size after the secondary recrystallization and good in the iron loss property. Particularly, the effect of decreasing the iron loss is large when the heating rate between RT and 700° C. is 50° C./s.

TABLE 1

| | Heating conditions for primary recrystallization annealing | | | | | Properties of steel sheet | | |
|---|---|---|---|---|---|---|---|---|
| No. | Heating rate between RT and 700° C. (° C./s) | T1 (° C.) | T2 (° C.) | Heating rate (° C./s) | Keeping time (s) | Grain size of secondary recrystallized grains (mm) | Iron loss $W_{17/50}$ (W/kg) | Remarks |
| 1 | 20 | — | — | — | — | 14.7 | 0.865 | Comparative Example |
| 2 | 50 | — | — | — | — | 17.5 | 0.853 | Comparative Example |
| 3 | 50 | 200 | 200 | 0 | 3 | 16.8 | 0.856 | Comparative Example |
| 4 | 50 | 450 | 450 | 0 | 3 | 10.8 | 0.838 | Invention Example |
| 5 | 50 | 450 | 450 | 0 | 11 | 18.8 | 0.911 | Comparative Example |
| 6 | 50 | 450 | 483 | 11 | 3 | 17.2 | 0.855 | Comparative Example |
| 7 | 50 | 530 | 550 | 10 | 2 | 10.3 | 0.833 | Invention Example |
| 8 | 50 | 560 | 570 | 5 | 2 | 19.6 | 0.902 | Comparative Example |
| 9 | 100 | — | — | — | — | 11.5 | 0.832 | Comparative Example |
| 10 | 200 | 380 | 380 | 0 | 7 | 9.0 | 0.810 | Invention Example |
| 11 | 200 | — | — | — | — | 11.5 | 0.822 | Comparative Example |
| 12 | 300 | 380 | 380 | 0 | 7 | 8.1 | 0.805 | Comparative Example |
| 13 | 300 | — | — | — | — | 8.4 | 0.811 | Comparative Example |

Example 2

A steel slab having a chemical composition shown in Table 2 is heated at 1200° C. for 20 minutes and hot rolled to obtain a hot rolled sheet of 2.0 mm in thickness, which is subjected to a hot band annealing at 1000° C. for 1 minute, subjected to primary cold rolling to a thickness of 1.5 mm, annealed at 1100° C. for 2 minutes and subjected to secondary cold rolling to obtain a cold rolled sheet having a final thickness of 0.23 mm and thereafter subjected to a magnetic domain subdividing treatment wherein linear grooves are formed on the steel sheet surface by electrolytic etching.

Then, the steel sheet is subjected to a primary recrystallization annealing combined with decarburization annealing wherein the sheet is heated from room temperature to 750° C. at various heating rates shown in Table 2 and heated from 750° C. to 840° at a heating rate of 10° C./s and kept in a wet hydrogen atmosphere of $P_{H2O}/P_{H2}=0.3$ for 2 minutes, and coated with an aqueous slurry of an annealing separator composed mainly of MgO and added with 10 mass % of $TiO_2$, dried, coiled, subjected to a final finish annealing, coated with a phosphate-based insulating tension coating and then subjected to a flattening annealing combined with baking and shape correction to obtain a product coil of grain-oriented electrical steel sheet.

A test specimen having a size of L: 320 mm×C: 30 mm is taken out from the product coil thus obtained in longitudinal and widthwise directions to measure an iron loss $W_{17150}$ by an Epstein test. The results are also shown in Table 2. As seen from Table 2, all of the steel sheets No. 4-12 subjected to heating of primary recrystallization annealing under conditions adapted to the invention are excellent in the iron loss property.

C. at a heating rate of 25° C./s and subjected to a primary recrystallization annealing combined with decarburization annealing in a wet hydrogen atmosphere. Thereafter, an aqueous slurry of an annealing separator composed mainly of MgO and added with 5 mass % of $TiO_2$, dried and final finish annealing is performed to obtain grain-oriented electrical steel sheets No. 1-4 shown in Table 3. In the production of the above grain-oriented electrical steel sheets, the temperature keeping is not performed on the way of the heating of the primary recrystallization annealing for the steel sheet No. 1, and nitriding is performed after the decarburization for the steel sheet No. 3, and the annealing separator containing 10 mass % of $MgSO_4$ in addition to $TiO_2$ is used for the steel sheet No. 4.

TABLE 2

| | Chemical composition (mass %) | | | | Heating rate of primary recrystallization annealing (° C./s) | | | | | Iron loss $W_{17/50}$ | |
|---|---|---|---|---|---|---|---|---|---|---|---|
| No. | C | Si | Mn | Others | RT-400 ° C. | 400-430° C. | 430-550° C. | 550-700° C. | 700-750° C. | (W/kg) | Remarks |
| 1 | 0.03 | 3.1 | 0.03 | — | 30 | 30 | 30 | 20 | 20 | 0.854 | Comparative Example |
| 2 | 0.03 | 3.1 | 0.03 | — | 30 | 40 | 40 | 250 | 20 | 0.798 | Comparative Example |
| 3 | 0.03 | 3.1 | 0.03 | — | 30 | 5 | 10 | 100 | 20 | 0.822 | Comparative Example |
| 4 | 0.03 | 3.1 | 0.03 | — | 30 | 5 | 40 | 100 | 20 | 0.800 | Invention Example |
| 5 | 0.03 | 3.1 | 0.03 | Ni: 0.03 | 30 | 5 | 40 | 100 | 20 | 0.784 | Invention Example |
| 6 | 0.03 | 3.1 | 0.03 | Cr: 0.04 | 30 | 5 | 40 | 100 | 20 | 0.788 | Invention Example |
| 7 | 0.03 | 3.1 | 0.03 | Sn: 0.02 | 30 | 5 | 40 | 100 | 20 | 0.779 | Invention Example |
| 8 | 0.03 | 3.1 | 0.03 | Mo: 0.02 | 30 | 5 | 40 | 100 | 20 | 0.788 | Invention Example |
| 9 | 0.03 | 3.1 | 0.03 | Bi: 0.001 | 30 | 5 | 40 | 100 | 20 | 0.782 | Invention Example |
| 10 | 0.03 | 3.1 | 0.03 | Ti: 0.002 | 30 | 5 | 40 | 100 | 20 | 0.784 | Invention Example |
| 11 | 0.03 | 3.1 | 0.03 | P: 0.008 | 30 | 5 | 40 | 100 | 20 | 0.780 | Invention Example |
| 12 | 0.03 | 3.1 | 0.03 | Nb: 0.001 | 30 | 5 | 40 | 100 | 20 | 0.783 | Invention Example |

Example 3

A test piece of 150 mm in width is taken out from the hot rolled sheet No. 1 of Table 2 used in Example 2 and heated in a laboratory at 1150° C. for one-side edge portion of the width (30 mm ranging from the widthwise end portion) and at 1050° C. for the other portion for 2 minutes to coarsen crystal grains at the one-side edge portion of the steel sheet. This treatment supposes a case that the steel sheet is overheated due to deceleration or the like caused by some troubles in the threading through the annealing line, and considers that when a material having crystal grains coarsened at this stage is subjected to post process under the same conditions as in the normal material, poor secondary recrystallization is easily caused by a change in texture or grain size of primary recrystallized grains.

Then, the hot rolled sheet is cold-rolled to obtain a cold rolled sheet having a final thickness of 0.23 mm, which is heated from room temperature to 750° at a heating rate of 100° C./s provided that 450° C. is kept for 3 seconds on the way of the heating, and further heated from 750° C. to 800°

From the grain-oriented electrical steel sheets thus obtained are taken out a total of 40 test specimens having a size of L: 320 mm and C: 30 mm wherein 5 specimens are taken in the widthwise direction and 8 specimens are taken in the longitudinal direction. After iron loss $W_{17/50}$ is measured by Epstein test, forsterite coating is removed from the steel sheet surface by pickling to observe secondary recrystallization state in an edge portion of the steel sheet.

These results are also shown in Table 3. Moreover, the iron loss value shown in Table 3 is an average value including an iron loss value of a test specimen heated at one-side edge portion to a higher temperature. As seen from these results, all of the steel sheets keeping at 450° C. for 3 seconds on the way of the heating of the primary recrystallization annealing are good in the iron loss property. In the steel sheet No. 3 subjected to the nitriding and the steel sheet No. 4 using the annealing separator added with $MgSO_4$ among them, poor secondary recrystallization (defect portion in which the secondary recrystallization is not caused) is not observed even in the one-side edge portion heated to a higher temperature, and the iron loss property is improved considerably.

TABLE 3

| | Production conditions | | | Properties of steel sheet | | |
|---|---|---|---|---|---|---|
| No. | Presence or absence of keeping at 450° C. for 3 seconds in primary crystallization annealing | Presence or absence of nitriding | Presence or absence of addition of $MgSO_4$ to annealing separator | Evaluation for appearance of secondary recrystallized grains | Iron loss $W_{17/50}$ (W/kg) | Remarks |
| 1 | absence | absence | absence | presence of faulty portion | 0.982 | Comparative Example |
| 2 | presence | absence | absence | presence of faulty portion | 0.921 | Invention Example |
| 3 | presence | presence | absence | absence or faulty portion | 0.892 | Invention Example |
| 4 | presence | absence | presence | absence of faulty portion | 0.898 | Invention Example |

INDUSTRIAL APPLICABILITY

The technique of the invention can be utilized for controlling texture of a thin steel sheet.

The invention claimed is:

1. A method of producing a grain-oriented electrical steel sheet, the method comprising:

hot rolling a steel slab to form a hot rolled steel sheet, the steel slab having a chemical composition comprising:

C: 0.001 to 0.10, by mass %;

Si: 1.0 to 5.0, by mass %;

Mn: 0.01 to 0.5, by mass %;

Al: less than 0.0100, by mass %;

each of S, Se, O and N: not more than 0.050, by mass %; and the remainder being Fe and inevitable impurities;

optionally hot band annealing the steel sheet;

subjecting the hot rolled sheet to a final thickness by (i) single cold rolling or (ii) two or more cold rollings including an intermediate annealing therebetween;

primary recrystallization annealing the cold rolled steel sheet by heating at a heating rate of not more than 10° C./s for a period of 1 to 7 seconds within a temperature zone in a range of 250° C. to less than 550° C. and rapidly heating at an average heating rate in a range of 40 to 200° C./s at a temperature in a range of 550° C. to 700° C.; and thereafter applying an annealing separator to perform final annealing.

2. The method of producing a grain-oriented electrical steel sheet according to claim 1, wherein the steel slab comprises one or more selected from Cu: 0.01 to 0.2, by mass %, Ni: 0.01 to 0.5, by mass %, Cr: 0.01 to 0.5, by mass %, Sb: 0.01 to 0.1, by mass %, Sn: 0.01 to 0.5, by mass %, Mo: 0.01 to 0.5, by mass %, Bi: 0.001 to 0.1, by mass %, Ti: 0.005 to 0.02, by mass %, P: 0.001 to 0.05, mass %, and Nb: 0.0005 to 0.0100, by mass %, in addition to the chemical composition.

3. The method of producing a grain-oriented electrical steel sheet according to claim 1, wherein at least one of a sulfide and a sulfate is added to the annealing separator.

4. The method of producing a grain-oriented electrical steel sheet according to claim 1, wherein a nitriding treatment is performed after the primary recrystallization.

5. The method of producing a grain-oriented electrical steel sheet according to claim 2, wherein at least one of a sulfide and a sulfate is added to the annealing separator.

6. The method of producing a grain-oriented electrical steel sheet according to claim 2, wherein a nitriding treatment is performed after the primary recrystallization.

* * * * *